US011756514B2

(12) United States Patent
Furlow

(10) Patent No.: US 11,756,514 B2
(45) Date of Patent: Sep. 12, 2023

(54) BONDED BOW

(71) Applicant: Carley Furlow, Harrisburg, PA (US)

(72) Inventor: Carley Furlow, Harrisburg, PA (US)

(73) Assignee: Village Girls LLC, Chester Springs, PA (US)

( * ) Notice: Subject to any disclaimer, the term of this patent is extended or adjusted under 35 U.S.C. 154(b) by 0 days.

(21) Appl. No.: 17/549,204

(22) Filed: Dec. 13, 2021

(65) Prior Publication Data

US 2022/0189440 A1 Jun. 16, 2022

Related U.S. Application Data

(60) Provisional application No. 63/124,258, filed on Dec. 11, 2020.

(51) Int. Cl.
*G10D 3/16* (2020.01)
*G10D 1/02* (2006.01)

(52) U.S. Cl.
CPC ..... *G10D 3/16* (2013.01); *G10D 1/02* (2013.01)

(58) Field of Classification Search
CPC .. G10D 1/00; G10D 3/00; G10D 1/02; G10D 3/16
See application file for complete search history.

(56) References Cited

FOREIGN PATENT DOCUMENTS

JP 5759057 B1 * 8/2015 ..... G10D 3/16
JP 2016118741 6/2016

* cited by examiner

*Primary Examiner* — Kimberly R Lockett
(74) *Attorney, Agent, or Firm* — Royal W. Craig; Gordon Feinblatt LLC

(57) ABSTRACT

A bonded bow device for providing injured-hand support to a musician in playing a stringed instrument with an injured, disabled or otherwise impaired wrist, finger(s) and/or hand, and to play with a more relaxed wrist. The bonded bow device generally comprises a base formed as an elongate resilient partial-tubular member interrupted by a lengthwise notch configured for clamping a frog of a bow. A double-finger collar is fixedly attached to the base. In use a musician inserts any two adjacent good fingers of either hand through the double-finger collar and furls all remaining healthy fingers around the base and bow. No matter the remaining grip strength, the support given by double-finger collar adds enough control to enable the musician to play.

14 Claims, 2 Drawing Sheets

BONDED BOW

CROSS-REFERENCE TO RELATED APPLICATION(S)

The present invention derives priority from U.S. Provisional Patent Application Ser. No. 63/124,258 filed 11 Dec. 2020.

BACKGROUND OF THE INVENTION

1. Field of the Invention

The present invention relates generally to accessories for use with the bows of stringed instruments and, more particularly, to a device for assisting a musician having an injury, disability, or other limiting circumstance that affects their grip, to nevertheless grip the bow of their violin, viola, bass, cello or the like.

2. Description of the Background

Novice musicians practice to improve while masters practice to maintain their mastery. All musician's practice regularly and frequently, and they despair greatly when they cannot. One of the most common distractions is an injury or disability to the bowing hand. Control over the bow of a stringed instrument requires complete finger dexterity and a strong grip. These qualities are impossible with any injury or disability to the bowing hand. For example, sprained or broken fingers are not uncommon, especially for high school or college athletes who also play a stringed instrument. Such injuries usually result in the musician/athlete wearing a splint for an extended time that joins two-to-three adjacent fingers together. Similarly, arthritis, carpal tunnel syndrome, and a broken wrist can prevent a musician from bending their finger, wrist, or from gripping anything, which typically results in prolonged abstinence from practicing.

Some musicians improvise by strapping their hand to their bow, but this is at best constricting and at worst cuts off circulation completely. What is needed is a device to allow a musician with an injured, disabled or otherwise impaired finger or hand to grip their bow despite impaired motor control, wearing a splint, and without having to bend their fingers and/or wrist.

There have been several attempts at teaching devices to instill a proper grip. For example, Japanese application JP2016118741 teaches a device that connects the bow to a musician's right hand for proper placement and bow hold. However, the device is merely a training tool for five finger posture when gripping the bow. It does help a musician having an injured finger while gripping their bow despite wearing a splint and without having to bend their fingers.

It would be greatly advantageous to provide a bonded bow, a device to provide bow support when a musician has an injured, disabled or otherwise impaired finger and/or wrist and cannot bend their hand, wrist and/or fingers.

SUMMARY OF THE INVENTION

It is a primary object of the invention to provide a bonded bow device for assisting with a musician's grip on their bow when necessary because of an injured, disabled or otherwise impaired hand or finger.

It is another object to provide a solution for musicians that allows them to play their stringed instrument despite sprained or broken fingers, arthritis, carpal tunnel syndrome, a broken wrist, or any other injured, disabled or otherwise impaired hand, wrist or finger.

It is another object to provide a bonded bow device as described above that does not require the musician to use all five fingers, but preferably only two.

It is another object to provide a bonded bow device as described above that reduces the need to bend the wrist while playing a stringed instrument, allowing play with a more relaxed wrist.

It is still another object to provide a bonded bow device as described above that can be used despite the musician wearing a splint.

According to the present invention there is provided a bonded bow device for providing injured-hand support to a musician in playing a stringed instrument with sprained or broken fingers, arthritis, carpal tunnel syndrome, a broken wrist, or any other injured, disabled or otherwise impaired hand, wrist or finger. The bonded bow device generally comprises a base formed as an elongate resilient partial-tubular member interrupted by a lengthwise notch configured for clamping a frog of a bow. A double-finger collar is fixedly attached to the base. In use a musician inserts any two adjacent good fingers of either hand through the double-finger collar and furls all remaining healthy fingers around the base and bow. No matter the remaining grip strength, the support given by double-finger collar adds enough control to enable the musician to play.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
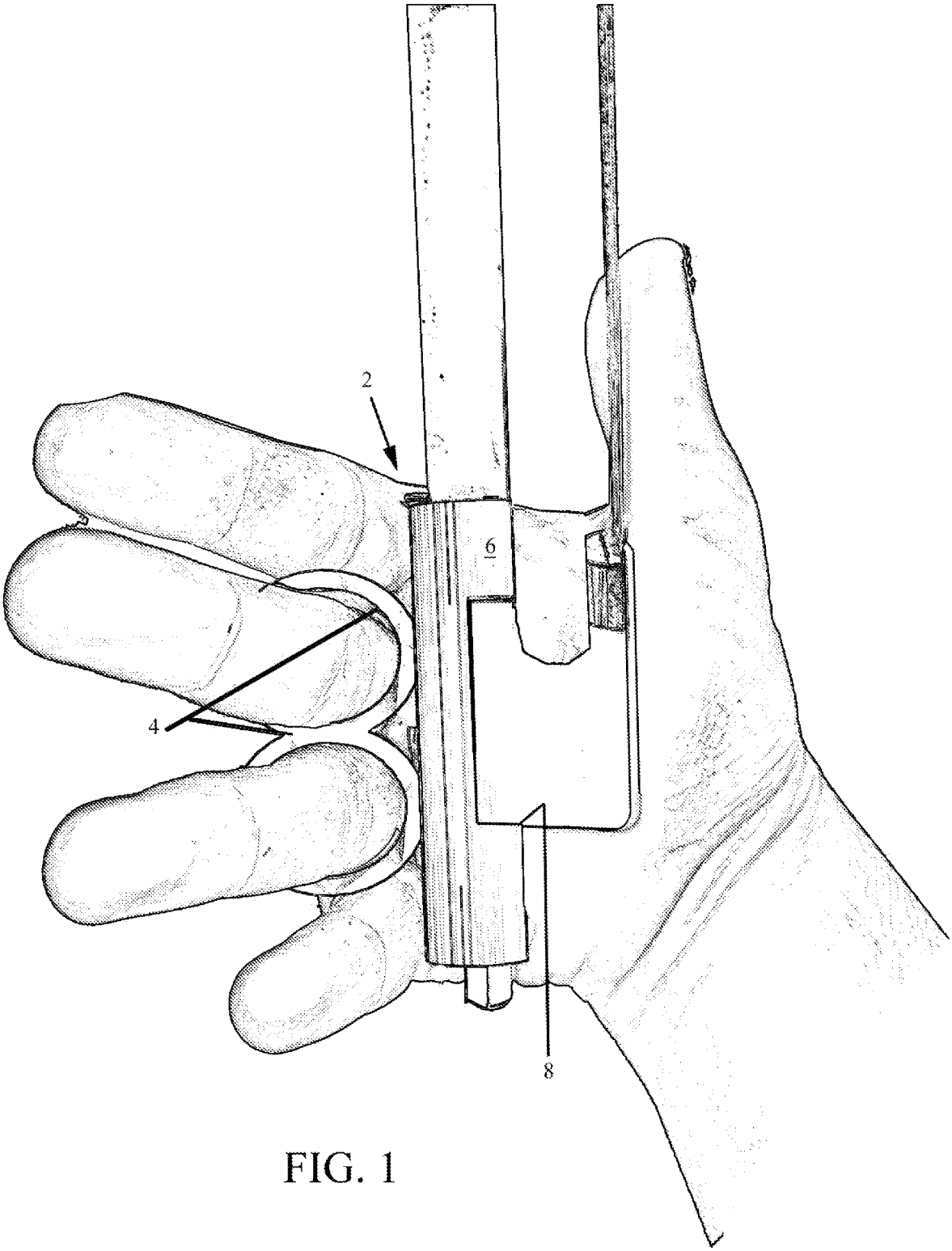
FIG. 1 is a perspective front view of an embodiment of the bonded bow device 2 according to an embodiment if the invention.
Figure 2:
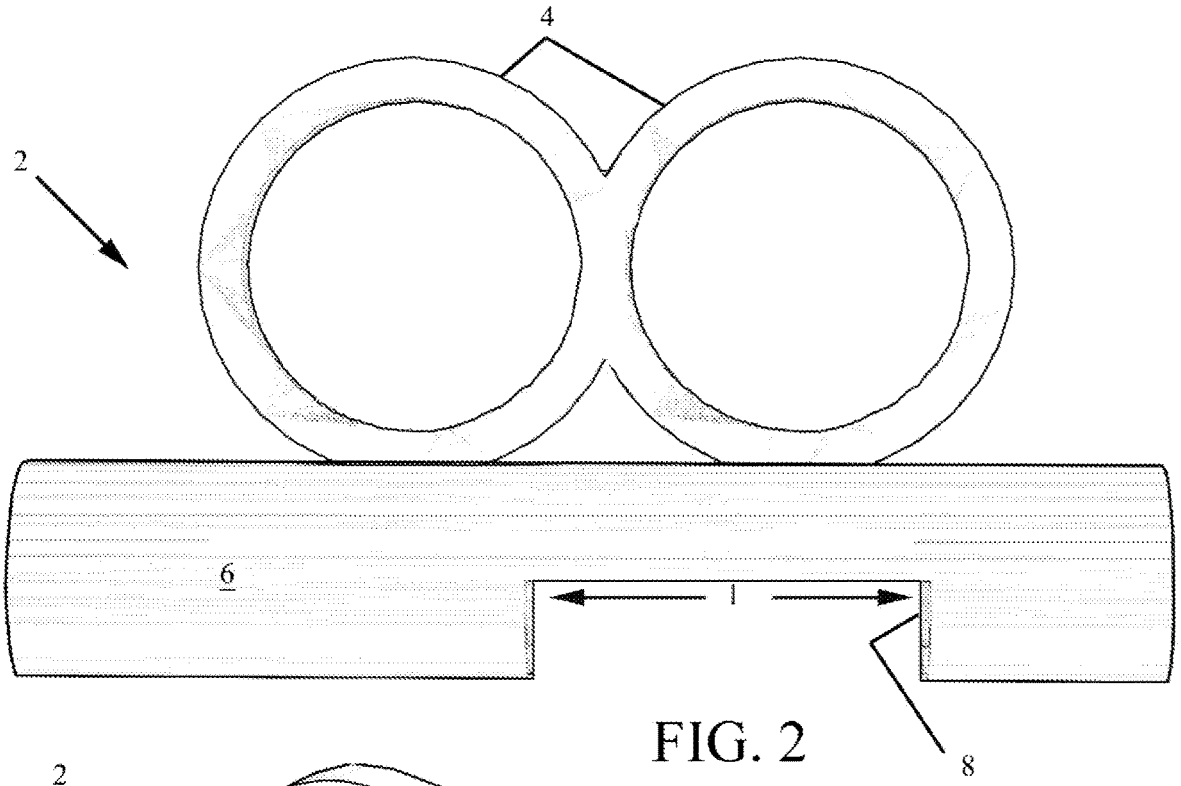
FIG. 2 is a side view of the bonded bow device 2 of FIG. 1.
Figure 3:
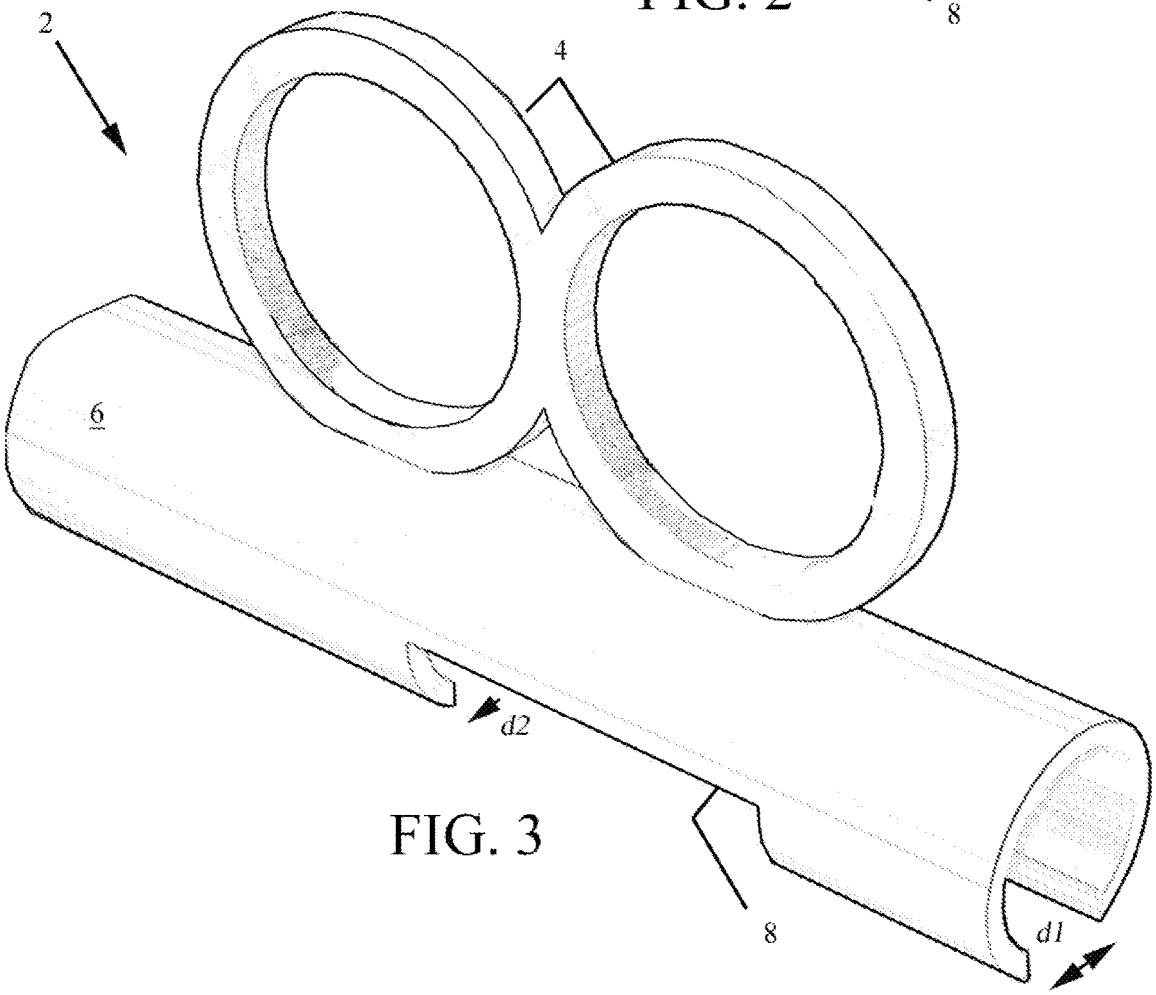
FIG. 3 is a side perspective view of the bonded bow device 2 of FIGS. 1-2.

The present invention is a bonded bow device for assisting with a musician's grip on their bow, when necessary, because of an injured or broken finger. FIGS. 1-3 show a bonded bow device 2 according to an embodiment of the invention. With combined reference to FIGS. 1-3 the bonded bow device 2 comprises a double-finger collar 4 fixedly attached to a base 6 that functions as a frog-clamp. The double-finger collar 4 comprises two side-by-side finger rings joined together in a figure-8 for encircling two adjacent fingers. One skilled in the art will understand that double-finger collar 4 may be a unitary component, e.g., machined or molded. Alternatively, double-finger collar 4 may be formed by bending a single strip into a curvilinear figure-eight. Each loop of double-finger collar 4 is fixedly attached to an elongate base 6 such that the double-finger collar protrudes radially therefrom and is secured at a minimum of two points. The base 6 is formed as an elongate resilient partial-tubular member interrupted by a lengthwise notch 8 that runs the entire length of the base 6. The base 6 preferably has partial-cylindrical walls having a C-shaped cross-section along the entire length of base 6. The notch 8 is a two-tier notch defined by resilient parallel sides 18 separated by a first distance $d_1$ slightly less than the typical thickness of a bow stick and configured for resilient insertion about the bow stick. Parallel sides 18 are interrupted centrally by a larger opening having sides 19 separated by a second larger distance $d_2$, thereby defining an aperture for accommodating a typical frog. The two-tier notch 8 effectively clamps around the bow stick and the frog, using the frog as a central anchor for a more secure grip. The base 4 is preferably of length equal to the musician's hand, within a range of from 2.5-4". This way, when desired, the musician can grip the base 4 lengthwise with their injured finger(s) as if it were the bow. The edges of base 4 may be coated with rubber to damp the grip.

A typical violin bow will have a diameter of about 5 mm at the head and 8.5 mm at the frog, the frog length is 20-25 mm, and the frog diameter 11-11.5 mm. In this case, two-tier notch 8 will be within a range of from 19-50 mm long, have resilient parallel sides 18 separated by a first distance $d_1$ within a range of from 7-8.4 mm, and a larger opening having sides 19 of length 20-25 mm separated by a second larger distance $d_2$ within a range of from 10.5-11.5 mm. One skilled in the art will understand that viola's, cellos and other stringed instruments will have different bow dimensions, and so the dimensions of the base 4 inclusive of two-tier notch 8 may be proportionately changed without detracting from functionality.

In use, as best seen in FIG. 3, the musician inserts any two adjacent good fingers of either hand through the two side-by-side finger rings of double-finger collar 4 and furls all remaining healthy fingers around the base 6 and bow. Thus, for example, as seen in FIG. 1 if the index finger is sprained, the musician inserts their two middle fingers through double-finger collar 4. Injured, broken and/or splinted fingers are left extended, and so in this example the musician musters a grip with their pinky, thumb and middle fingers. No matter the remaining grip strength, the support given by double-finger collar 4 adds enough control to enable the musician to play.

The embodiment of FIGS. 1-3 is preferably formed by injection molding, but may alternatively be formed of two components 4, 6 bonded together.

It should now be apparent that the that the bonded bow device 2 supplements a musician's grip on their bow despite injured, broken and/or splinted fingers, and thereby allows them to keep playing and practicing without bending their injured finger(s) or wrist. The device can be used despite the musician wearing a splint and can be used to play with either hand.

Accordingly, the specification and drawings are to be regarded in an illustrative rather than exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A bonded bow device for assisting a musician in gripping a bow of a stringed instrument despite an injured, disabled or otherwise impaired hand, wrist or finger, the bow of said stringed instrument including a bow stick and a frog, the bonded bow device comprising:

a base formed as an elongate resilient partial-tubular body interrupted by a lengthwise two-tier notch defined by parallel sides interrupted by a larger central opening configured for clamping around said bow stick with the frog anchored in the larger central opening; and a double-finger collar comprising two conjoined loops attached to said base and protruding rigidly there from.

2. The bonded bow device of claim 1, wherein both conjoined loops of said finger collar are attached to said base.

3. The bonded bow device of claim 2, said finger collar protrudes radially from said base.

4. The bonded bow device of claim 1, wherein said base comprises partial-cylindrical walls having a C-shaped cross-section along its entire length.

5. The bonded bow device of claim 1, wherein said two-tier notch comprises parallel sides separated by a first distance d1 and interrupted by a larger central opening separated by a second distance d2, where d2 is ≥d1.

6. The bonded bow device of claim 1, wherein said double finger collar is attached to said base opposite said central opening and protrudes radially from said base.

7. The bonded bow device of claim 1, wherein both conjoined loops of said finger collar are attached to said base opposite said central opening and protrude radially from said base.

8. The bonded bow device of claim 7, wherein said base clamps around said bow stick and said frog and is anchored in position by said two-tier notch a using the frog of said bow as a central anchor.

9. A bonded bow device for assisting a musician in gripping a bow of a stringed instrument despite an injured, disabled or otherwise impaired hand, wrist or finger, the bow of said stringed instrument including a bow stick and a frog, the bonded bow device comprising:

a base formed as an elongate rigid and resilient partial-tubular body interrupted by a lengthwise two-tier notch defined by parallel sides interrupted by a larger central opening, and configured for clamping around the bow stick of said bow with the frog anchored in the larger central opening; and a double-finger collar attached to said base, said double-finger collar comprising two conjoined loops both rigidly attached to said base.

10. The bonded bow device of claim 9, wherein said base comprises partial-cylindrical walls having a C-shaped cross-section along its entire length.

11. The bonded bow device of claim 10, wherein said double finger collar protrudes radially from the external wall of said base.

12. The bonded bow device of claim 9, wherein said two-tier notch comprises parallel sides separated by a first distance d1 and interrupted by a larger central opening separated by a second distance d2, where d2 is ≥d1.

13. The bonded bow device of claim 9, wherein said double finger collar is attached to said base opposite said central opening and protrudes radially from said base.

14. The bonded bow device of claim 9, wherein said base clamps around said bow stick and frog and is anchored in position by the frog protruding though the larger central opening of said two-tier notch.

* * * * *